US008919727B2

(12) United States Patent
Khoo

(10) Patent No.: US 8,919,727 B2
(45) Date of Patent: Dec. 30, 2014

(54) ELEVATED FLOOR AND CEILING SLAB FORMWORK SYSTEM

(76) Inventor: Tian Khoo, Kuala Lumpur (MY)

( * ) Notice: Subject to any disclaimer, the term of this patent is extended or adjusted under 35 U.S.C. 154(b) by 109 days.

(21) Appl. No.: 13/381,135

(22) PCT Filed: Apr. 13, 2010

(86) PCT No.: PCT/MY2010/000053

§ 371 (c)(1),
(2), (4) Date: Dec. 28, 2011

(87) PCT Pub. No.: WO2011/002271

PCT Pub. Date: Jan. 6, 2011

(65) Prior Publication Data

US 2012/0112376 A1 May 10, 2012

(30) Foreign Application Priority Data

Jun. 29, 2009 (MY) ..... 20092760

(51) Int. Cl.
*E04G 11/38* (2006.01)
*E04G 11/48* (2006.01)
*E04G 11/50* (2006.01)

(52) U.S. Cl.
CPC ..... *E04G 11/50* (2013.01); *E04G 11/486* (2013.01); *E04G 11/48* (2013.01); *E04G 11/38* (2013.01)
USPC ..... 249/18

(58) Field of Classification Search
CPC ..... E04G 11/36; E04G 11/38; E04G 11/48; E04G 11/483; E04G 11/486; E04G 11/50; E04G 11/52; E04G 11/54; E04G 11/56
USPC ..... 249/18, 13; 108/147.19, 155, 157.15, 108/157.17, 159
See application file for complete search history.

(56) References Cited

U.S. PATENT DOCUMENTS 1,490,461 A * 4/1924 Garlinghouse ..... 249/18
1,498,665 A * 6/1924 MacIvor ..... 249/18
(Continued)

FOREIGN PATENT DOCUMENTS

AT 270983 * 5/1969 ..... E04G 11/36
CA 2147406 C * 12/2005 ..... E04G 11/50
(Continued)

*Primary Examiner* — Michael Safavi
(74) *Attorney, Agent, or Firm* — Tutunjian & Bitetto, P.C.

(57) ABSTRACT

A slab formwork system (100), consisting of a plurality of vertical supports supporting a plurality of panels is provided characterized in that the slab formwork system (100) includes a plurality of vertical main members (101,102,103) whose height is adjustable by an operator such that each top of the vertical main member (101,102,103) is at the same level when referenced from an imaginary lower horizontal line, at least one primary bearer (301), wherein the primary bearer (301) is supported by the plurality of vertical main members (101,102,103) wherein each vertical main member (101,102,103) is perpendicular to each primary bearer (301), a pair of adjustable struts (246) in each vertical main member (101,102,103), wherein each adjustable strut (246) is diagonally connectable to the vertical main member (101,102,103) and the primary bearer (301), a plurality of height adjustable props (502) connectable perpendicularly to at least one filler panel (410), a plurality of secondary bearers (303) wherein the secondary bearers (303) are disposed perpendicular on top of the primary bearers (301), a longitudinally extendable element (315) connectable to terminal end of the primary bearer (301) supported by a plurality of vertical main members (103) and a plurality of panels (407) assembled on top of the secondary bearers (303) to receive concrete wherein each filler panel (410) is disposed between at least two panels (407).

6 Claims, 14 Drawing Sheets

(56) References Cited

U.S. PATENT DOCUMENTS

| | | | | | |
|---|---|---|---|---|---|
| 3,784,151 | A | * | 1/1974 | Steele | 249/18 |
| 3,827,665 | A | * | 8/1974 | Kistler | 248/354.5 |
| 3,847,340 | A | * | 11/1974 | Ficken et al. | 249/18 |
| 3,966,164 | A | * | 6/1976 | Dashew | 249/18 |
| 4,003,541 | A | * | 1/1977 | Lanier | 249/18 |
| 4,122,645 | A | * | 10/1978 | Tooley | 52/651.1 |
| 5,643,487 | A | * | 7/1997 | Malone | 249/18 |
| 6,059,258 | A | * | 5/2000 | Jackson | 249/18 |
| 6,176,463 | B1 | * | 1/2001 | Rock | 249/18 |
| 6,189,854 | B1 | * | 2/2001 | Irurzun Saez De Maturana | 249/18 |
| 6,913,422 | B2 | * | 7/2005 | Rogers | 405/272 |
| 8,100,378 | B1 | * | 1/2012 | Casini | 249/18 |
| 2007/0200049 | A1 | * | 8/2007 | Coday | 249/18 |
| 2009/0294627 | A1 | * | 12/2009 | Schwoerer | 249/18 |

FOREIGN PATENT DOCUMENTS

| | | | | | |
|---|---|---|---|---|---|
| DE | 1269326 | | * | 5/1968 | E04G 11/50 |
| DE | 2621093 | | * | 12/1976 | E04G 11/36 |
| EP | 0048624 | A2 | | 3/1982 | |
| FR | 2597534 | A1 | * | 10/1987 | E04G 11/36 |
| GB | 2127474 | A | * | 4/1984 | E04G 11/48 |
| KR | 10-2002-0002142 | A | | 1/2002 | |
| KR | 10-0544093 | B1 | | 1/2006 | |
| KR | 10-0655505 | B1 | | 12/2006 | |
| KR | 10-0769999 | B1 | | 10/2007 | |
| KR | 10-0769999 | B1 | * | 10/2007 | E04G 11/48 |
| KR | 10-2008-0104534 | A | | 12/2008 | |

* cited by examiner

Section A-A

Section B-B

Section A-A

Section B-B

Section A-A

Section B-B

Section A-A

Section B-B

Section A-A

Section B-B

Section A-A

Section B-B

Section A-A

Section B-B

ELEVATED FLOOR AND CEILING SLAB FORMWORK SYSTEM

FIELD OF INVENTION

The present invention relates to a slab formwork system for the construction of elevated floors and ceilings of lower levels.

BACKGROUND ART

In the construction of concrete buildings, it is known to employ for the casting of various parts of a building such as ceilings, slab formwork that include various components. Slab formwork systems consist of prefabricated timber, steel or aluminum beams and formwork modules. Modules are often no larger than 6 to 9 feet or 2 to 3 meters in size. The beams and formwork are typically set by hand and pinned, clipped, or screwed together. The advantages of a modular system are that the system does not require a crane to place the formwork, speed of construction with unskilled labor, formwork modules can be removed after concrete sets leaving only bearers in place prior to achieving design strength.

United States Patent Application No. 2006/0042179 describes a slab formwork system with panel support beams underlying and supporting the panel support beams that have upwardly facing panel support surfaces extending along the panel support beams. The formwork panels have a pair of parallel, elongate intermediate members extending between and interconnecting parallel elongate side members and a sheet of material supported on the side and intermediate members. Connecting clips are retained in the downwardly open recesses that engage with support beams to secure the formwork panels to the support beams. As these fixtures require more labor intensive methods to deploy, a system of this nature takes a longer time to set up and is more difficult to assemble as it has a large number of components that are required to set up the system. This becomes a costly system as each part adds on to overall cost of the system.

Another method known in the art is disclosed in Canadian Patent 1055991 where a shoring or scaffold for construction uses stacked scaffold sections of a demountable type and having a height adjusting construction is provided. Each section has a pair of spaced apart end frames that are demountably cross-connected with respect to each other and the end frames of upper and lower sections have a telescopic adjustable relation to meet height requirements. However, this method does not provide ease of assembly as it requires some degree of mounting of the scaffolding before the construction can be done. This system and method is time-consuming due to the complexity of assembly and also requires the scaffold to be left in for longer periods while the concrete hardens. As a result, many scaffold units are needed to be in rotation for multiple cycles. This increases the turnover rate for said scaffold units.

This results in a longer cycle time as it requires the scaffold to be left in until the concrete completely hardens as the scaffold may not be removed before the concrete slab has reached the required strength. In existing scaffolds, the entire scaffold unit must be left in to provide support for the concrete slab for up to 3 weeks.

It is also known that the systems seen above require workers to manually adjust height of scaffolds by climbing up the elevated heights. This reduces overall productivity of the workers as it is a time consuming effort to climb on top of the scaffolds.

There is a need for a method or system for providing ease of assembly of formwork as well as a relatively lower cost to be used in construction of various parts of a building. There is also a need for a system that has a reduced cycle time where the scaffolds can be removed quickly without having to wait for the concrete to completely harden. This is in order to enable fewer scaffolds to be in rotation to reduce operational costs. There is also a need for a system that increases the productivity of workers who are using scaffolds in order to use the scaffolds efficiently.

SUMMARY OF THE INVENTION

Accordingly, there is provided a slab formwork system, consisting of a plurality of vertical supports supporting a plurality of panels characterized in that the slab formwork system includes a plurality of vertical main members whose height is adjustable by an operator such that each top of the vertical main member is at the same level when referenced from an imaginary lower horizontal line, at least one primary bearer, wherein the primary bearer is supported by the plurality of vertical main members wherein each vertical main member is perpendicular to each primary bearer, a pair of adjustable struts in each vertical main member, wherein each adjustable strut is diagonally connectable to the vertical main member and the primary bearer, a plurality of height adjustable props connectable perpendicularly to at least one filler panel, a plurality of secondary bearers wherein the secondary bearers are disposed perpendicular to the primary bearers, a longitudinally extendable element connectable to terminal end of the primary bearer and a plurality of panels assembled on top of the secondary bearers to receive concrete wherein each filler panel is disposed between at least two panels.

There is also provided a filler panel, characterized in that the filler panel is positionable between two adjacent panels with a void between the two adjacent panels, wherein the filler panel is relatively shorter in length than said void.

There is also provided a method of laying slab formwork using a plurality of vertical support members supporting a plurality of panels, characterized in that, the method includes the steps of, positioning a plurality of vertical main members in a spaced apart manner, connecting adjacent vertical main members to each other using a horizontal tie unit and a pair of cross braces, adjusting height of the vertical main members such that each top of the vertical main members is at the same horizontal level when referenced from an imaginary lower horizontal line, positioning a primary bearer flat on top of the vertical main members, positioning a secondary bearer flat on top of the primary bearer in a perpendicular relationship, connecting a plurality of adjustable struts to a primary bearer, adjustably securing one end of the primary bearer to a wall or an intended wall, disposing a plurality of panels on top of the plurality of secondary bearers, disposing a filler panel between adjacent panels and sealing void created between the filler panel and the adjacent panels by an adhesive tape, receiving concrete on top of the plurality of panels.

There is also provided a method of removing slab formwork, said formwork comprises of a plurality of vertical support members supporting a plurality of panels characterized in that, the method includes the steps of positioning height adjustable props between ground level and a filler panel, removing vertical main members while leaving height adjustable props in said position and removing height adjustable props upon complete hardening of concrete slab.

There is also provided a vertical main member for use in a slab formwork system characterized in that, the vertical main member includes a lower longitudinal member, an upper longitudinal member connected to the lower longitudinal member by a height adjustable means wherein the upper longitudinal member further includes a pair of adjustable struts connectable to a primary bearer.

The present invention consists of several novel features and a combination of parts hereinafter fully described and illustrated in the accompanying description and drawings, it being understood that various changes in the details may be made without departing from the scope of the invention or sacrificing any of the advantages of the present invention.

BRIEF DESCRIPTION OF DRAWINGS

The drawings constitute part of this specification and include an exemplary or preferred embodiment of the invention, which may be embodied in various forms. It should be understood, however, the disclosed preferred embodiments are merely exemplary of the invention. Therefore, the figures (not to scale) disclosed herein are not to be interpreted as limiting, but merely as the basis for the claims and for teaching one skilled in the art of the invention.

DETAILED DESCRIPTION OF THE PREFERRED EMBODIMENTS

The present invention relates to a slab formwork system, consisting of a plurality of vertical supports supporting a plurality of panels. Hereinafter, this specification will describe the present invention according to the preferred embodiments of the present invention. However, it is to be understood that limiting the description to the preferred embodiments of the invention is merely to facilitate discussion of the present invention and it is envisioned that those skilled in the art may devise various modifications and equivalents without departing from the scope of the appended claims.

The following detailed description of the preferred embodiments will now be described in accordance with the attached drawings, either individually or in combination.

Figure 1:
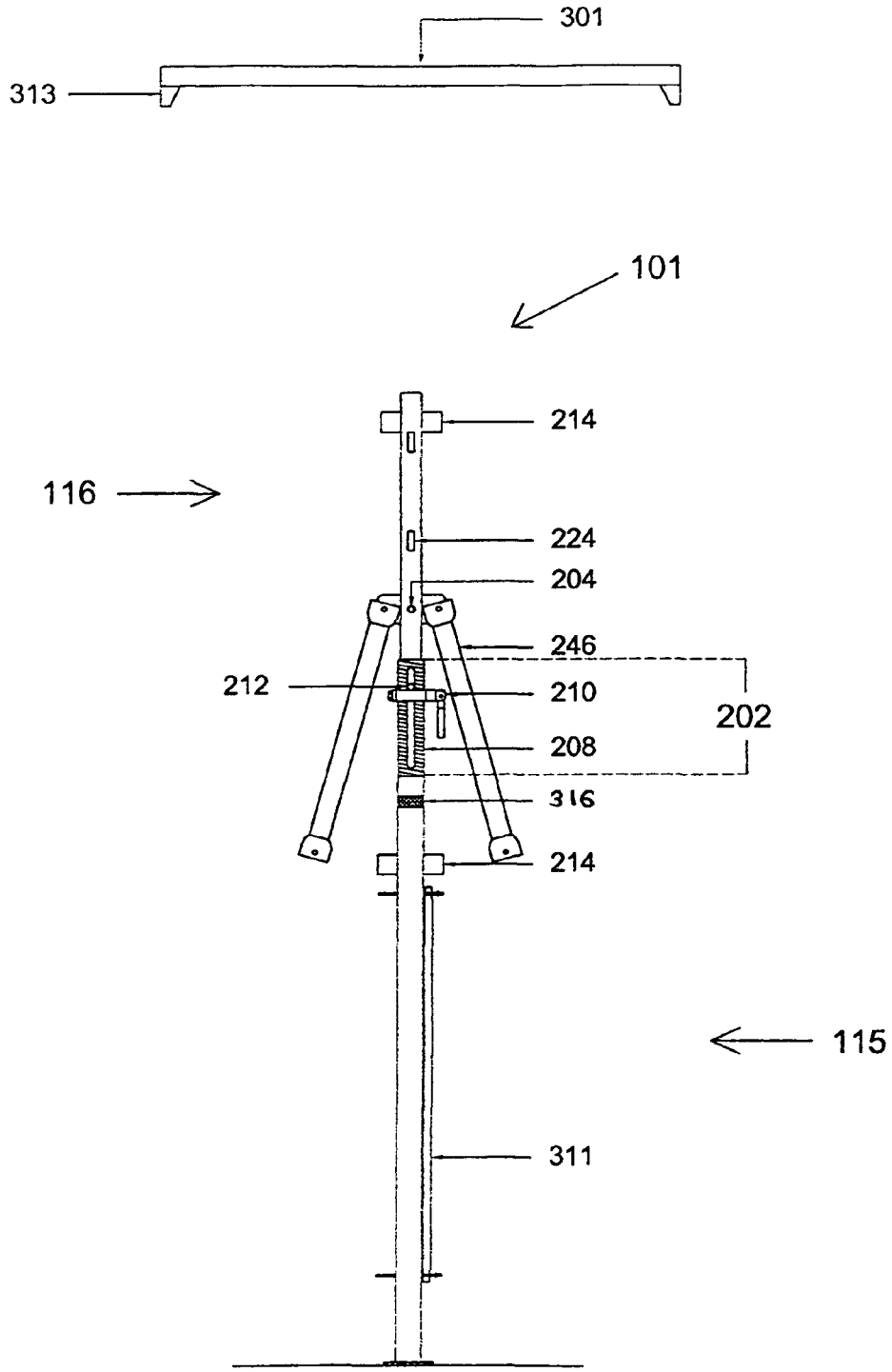
FIG. 1 shows a front view of a vertical main member in an embodiment of a slab formwork system with longitudinal members.
Figure 4A:
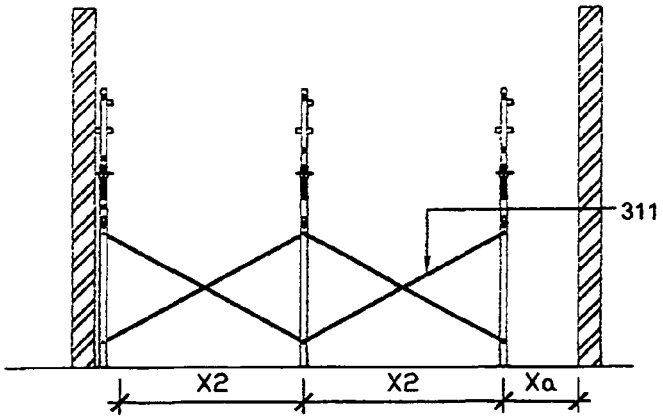
FIG. 4A shows a sectional side view of the placement of vertical main members in a slab formwork system.
Figure 4:
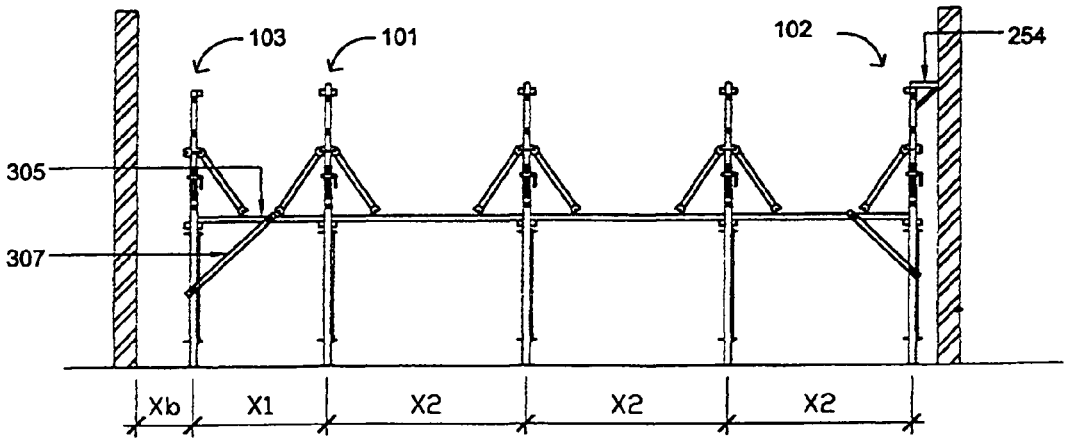
FIG. 4 shows a sectional front view of the placement of vertical main members in a slab formwork system.

An embodiment of the present invention is depicted in FIG. 1, wherein a slab formwork system (100) for the construction of concrete floor slabs are shown. The slab formwork system (100) includes a plurality of vertical main members (101,102,103) as seen in FIG. 4, whose height is adjustable by an operator such that each top of the vertical main member (101,102,103) is at the same level when referenced from an imaginary lower horizontal line. The imaginary lower horizontal line is produced by projecting a laser beam from one end of a wall (111) to a second wall at an opposite end. The imaginary lower horizontal line is used as a reference point to ensure that each top of the vertical main member (101,102,103) is leveled. The imaginary lower horizontal line may also be produced by other means such as a length of string from one end of a wall (111) to a second wall at an opposite end.

Figure 1A:
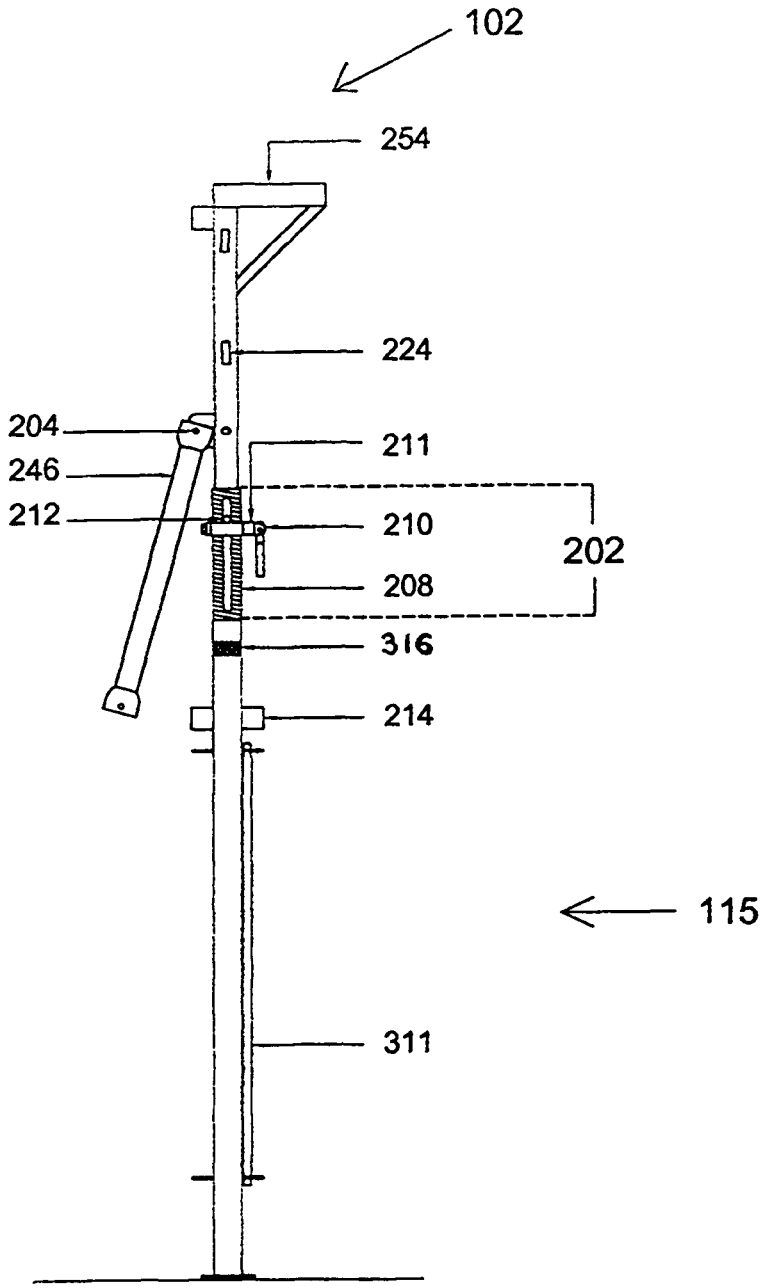
FIG. 1A shows a front view of a vertical main member with the parts of a height adjustable means in an embodiment of a slab formwork system.

Each vertical main member (101,102,103) includes a lower longitudinal member (115) and an upper longitudinal member (116). The lower longitudinal member (115) and the upper longitudinal member (116) are connectable by means of a height adjustable means (202) as seen in FIG. 1. The height adjustable means (202) in this embodiment is a telescopically engageable means. As seen in FIG. 1A, the height adjusting means (202) in this preferred embodiment includes a threaded longitudinal portion (208) adapted to facilitate the vertical movement of an adjustable nut (211) and handle (210) relative to the vertical main members (101,102,103) where the adjustable nut (211) and handle (210) is used to hold a bar pin (212) in place. Rotational movement of the handle (210) translates to vertical movement of the nut (211) in order to move within the threaded longitudinal portion (208). The lower longitudinal member (115) supports a bar pin (212) bearing upon a nut (211) and wherein the nut (211) is axially moveable along the lower longitudinal member (115). A pair of adjustable struts (246) is further hinged along the length of each upper portion (116) of the vertical main member. This will be described in detail later in the following paragraphs.

FIG. 1A also shows a shoulder (254) that connects a vertical main member (102) positioned next to a wall (111). This connection is also depicted in FIGS. 4-7 where the shoulder (254) is fixed to the adjacent wall (111).

Figure 2:
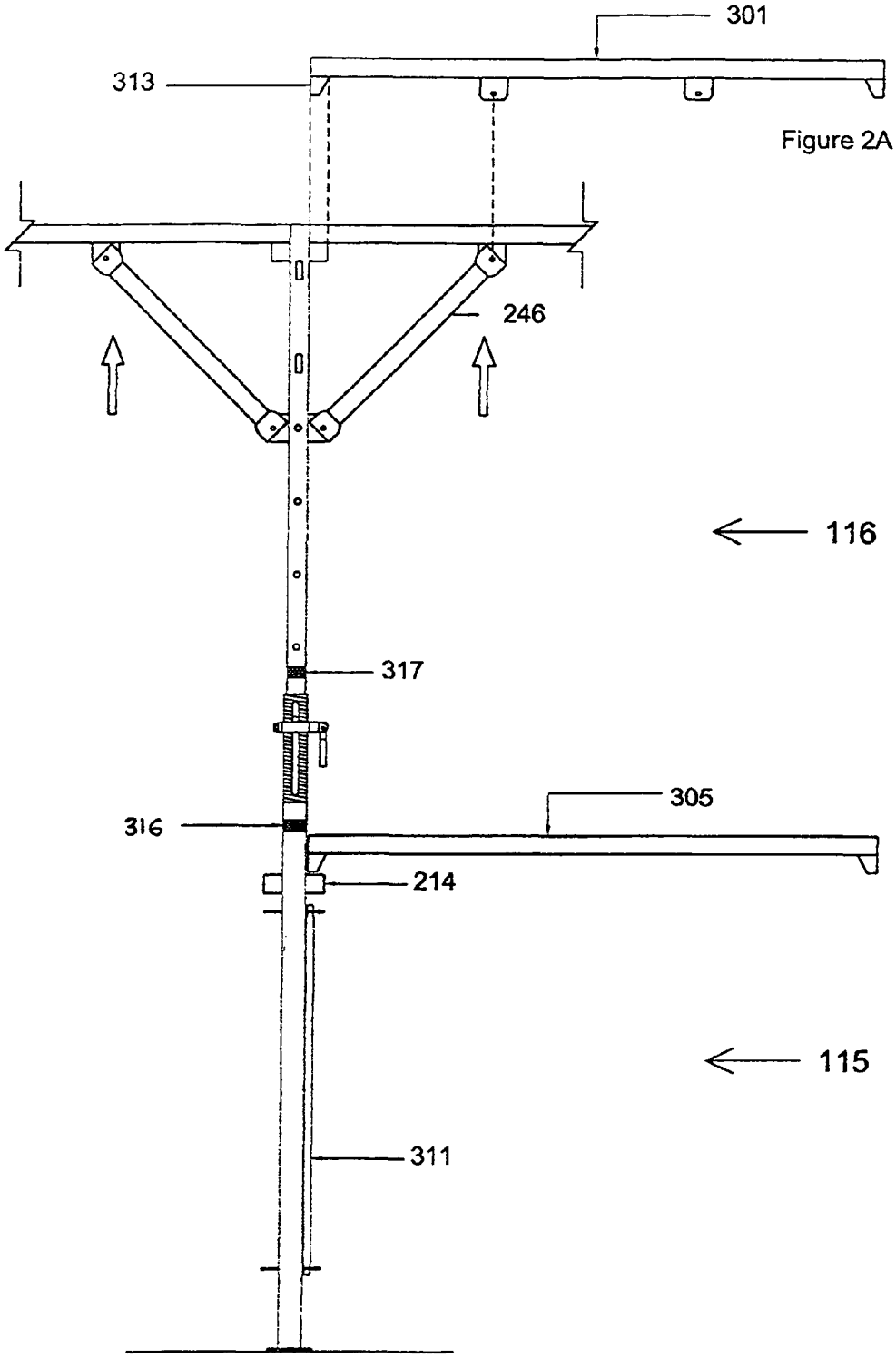
FIG. 2 shows a front view of a vertical main member showing the attaching of the vertical main members to the longitudinally extendable element in a slab formwork system.

The system (100) further includes a plurality of primary bearers (250) which are supported by the plurality of vertical main members (101,102,103). Each vertical main member (101,102,103) is positioned perpendicular to the primary bearer (301) to provide support to the primary bearer (301) as seen in FIG. 11. Each vertical main member (101,102,103) is connected to the primary bearer (301) by mating pin (313) protruding from underside of the primary bearer (301) to pocket (214). The vertical main members (101,102,103) can be connected to the primary bearer (301) by other various connecting means, such as a U-shaped clamp, nut and bolt, a horizontal bar and pin, and key-hole shaped inserts. A pair of adjustable struts (246) is included in a vertical main member (101,102,103) as shown in FIGS. 1 and 2 wherein each adjustable strut (246) is diagonally connectable to the vertical main member (101,102,103) and the primary bearer (250) as an additional support. The adjustable struts (246) are connected to the primary bearer (301) and the vertical main member (101,102,103) by various connecting means. In this embodiment, the connecting means depicted are a hinge joint (204) in the vertical main member (103) (see FIG. 1). The lower component (115) includes cross braces (311) extending laterally between two adjacent vertical main members (101,102,103) as seen in FIG. 11A. A plurality of secondary bearers (303) is positioned perpendicularly on top of the primary bearers (301).

Figure 3:
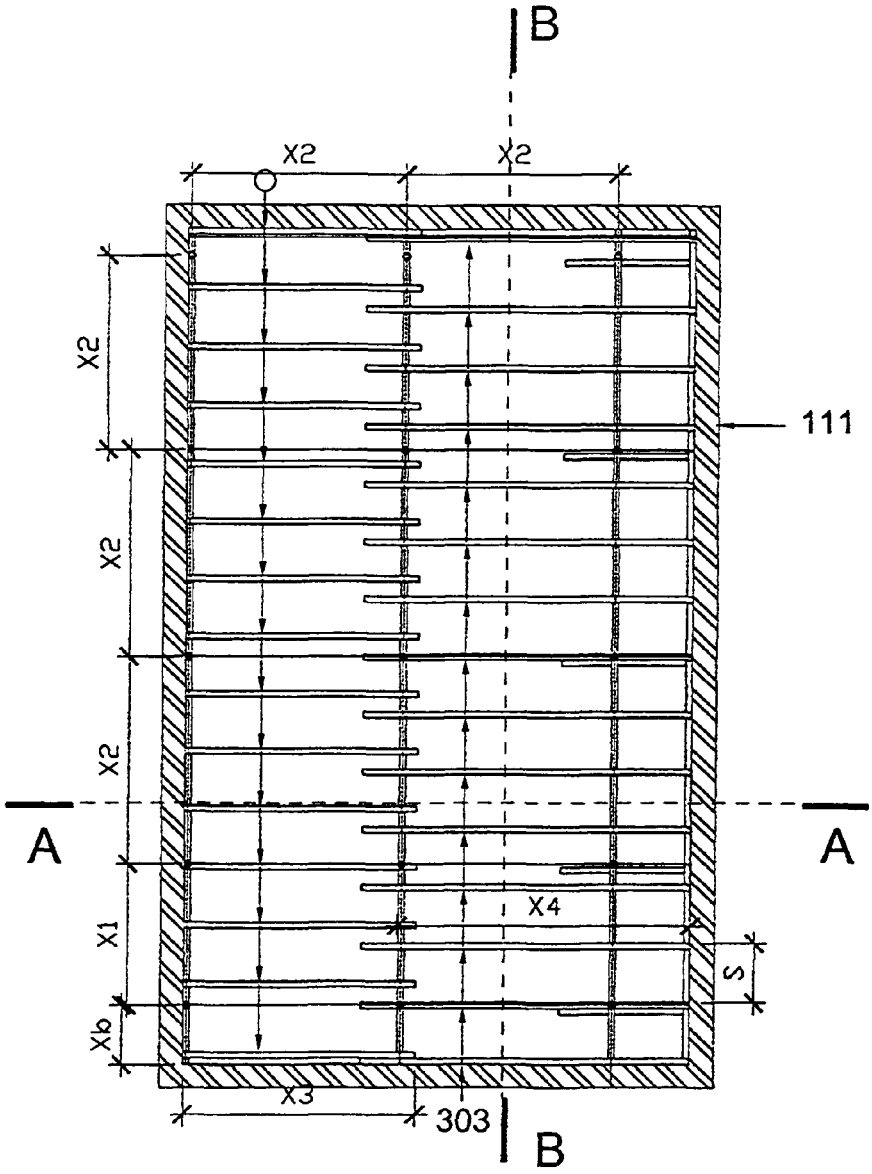
FIG. 3 shows a top view of a slab formwork system.

FIG. 3 illustrates a top view of the slab formwork system which shows the secondary bearers placement in the slab formwork system (100).

Figure 8:
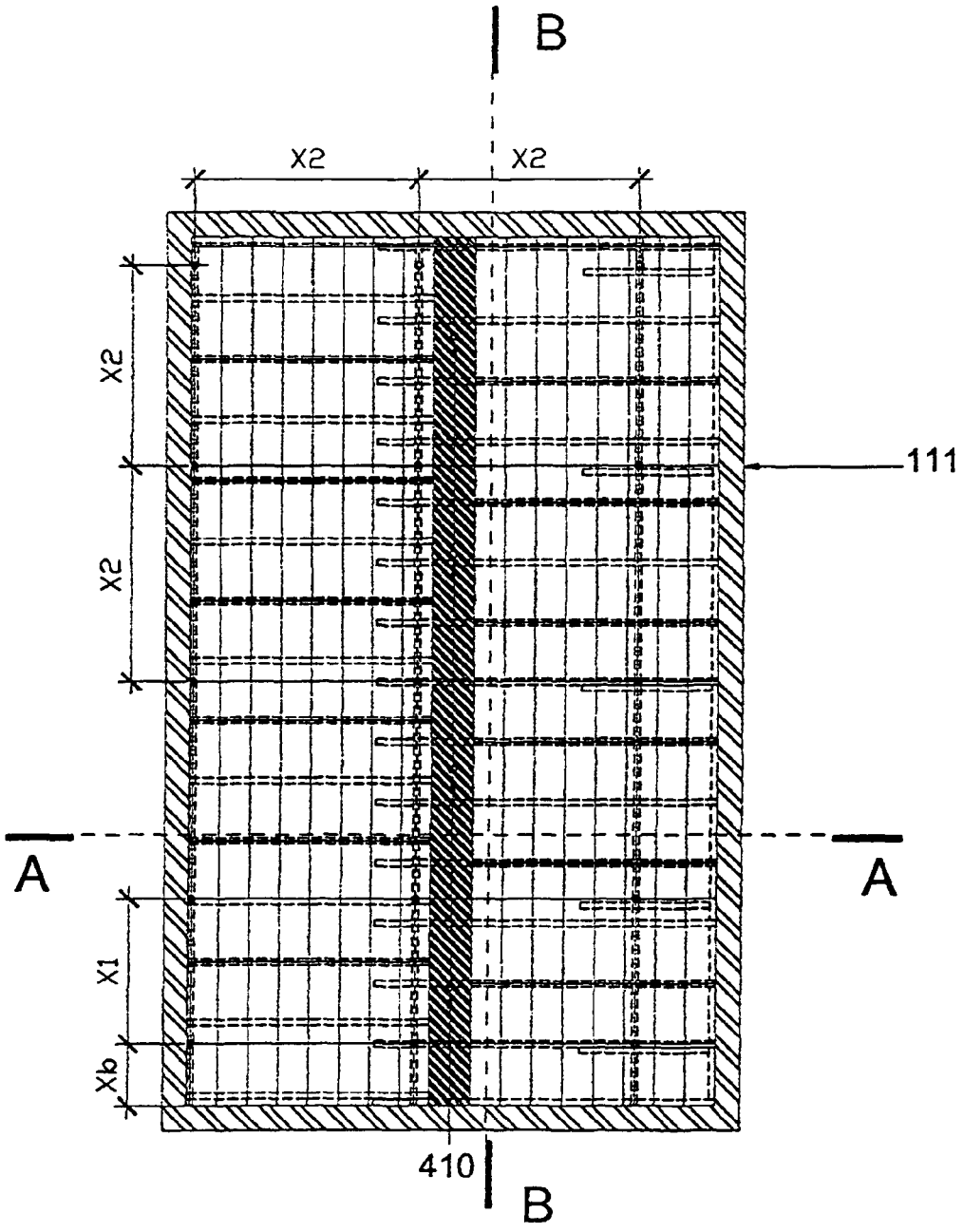
FIG. 8 shows a top view of a slab formwork system with the positioning of a filler panel in a slab formwork system.
Figure 11B:
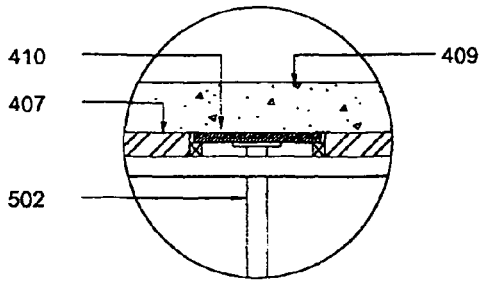
FIG. 11B shows a magnified view of the positioning of height adjustable props to a filler panel before dismantling the slab formwork system.
Figure 11A:
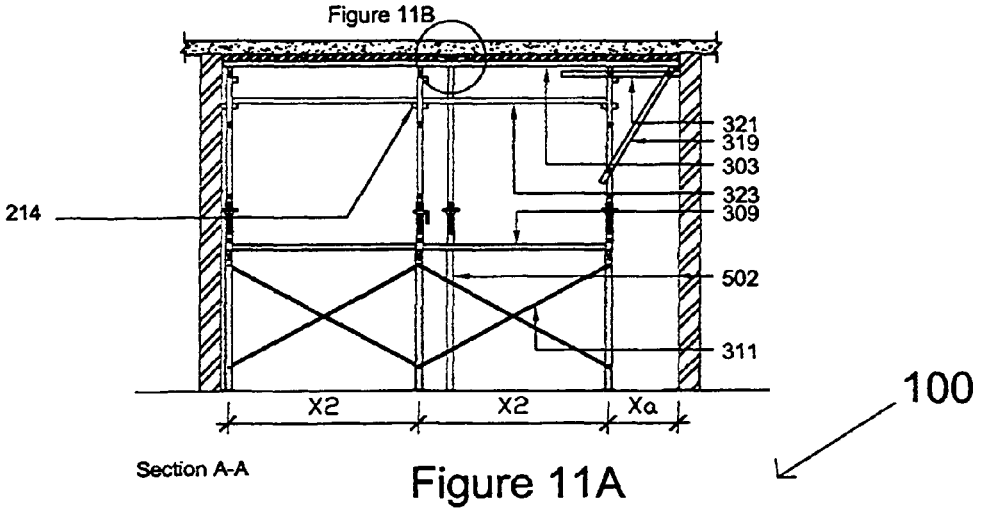
FIG. 11A shows a sectional view of the positioning of height adjustable props to a filler panel before dismantling the slab formwork system.
Figure 11:
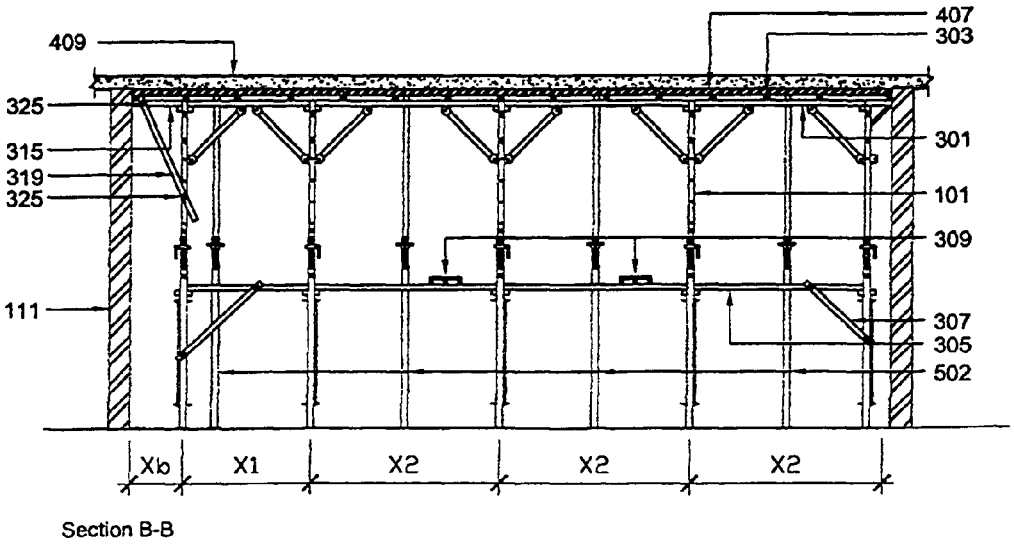
FIG. 11 shows a cross section of the positioning of height adjustable props to a filler panel before dismantling the slab formwork system.

The system (100) further includes a plurality of height adjustable props (502) connectable perpendicularly as seen in FIG. 11B. Each height adjustable prop (502) is connected to a filler panel (410) where the filler panel (410) is disposed between at least two panels (407). The filler panel (410) is horizontally positioned between panels (407) so as to seal a void created between the filler panel (410) and adjacent panels (407). Each height adjustable prop (502) is perpendicularly positioned to the filler panel (410) before dismantling the slab formwork system (100). Multiple filler panels (410) are used depending on the spatial size of the slab formwork system (100). The embodiment of the invention in FIG. 8 depicts one continuous filler panel (410) positioned in the slab formwork system (100). However, a plurality of filler panels (410) may be used when the spatial size of the slab formwork system (100) is relatively large.

Figure 1B:
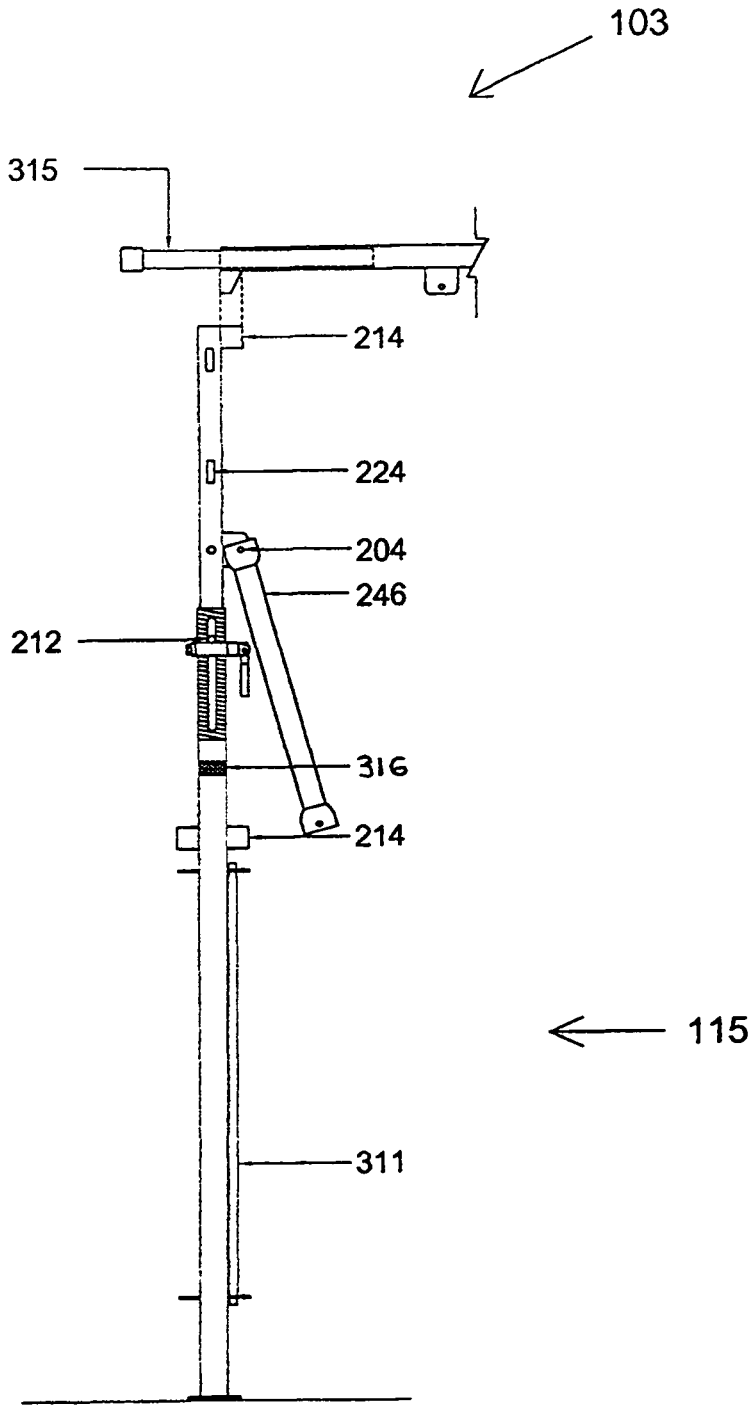
FIG. 1B shows a front view of a vertical main member depicting a longitudinally extendable element in a slab formwork system.

A longitudinally extendable element (315) is further included in the system (100) wherein one end of the longitudinally extendable element (315) is supported by one of the vertical main members (103) as seen in FIG. 11 and FIG. 1B. In this embodiment, a longitudinally extendable element (315) is connected to one end of the primary bearer (301) by means of inserting the longitudinally extendable member (315) into the primary member (301). The longitudinally extendable element (315) is supported by a diagonally positioned strut pipe (319) and the vertical main members (103) are connected by a clamp. A plurality of panels (407) is assembled on top of the secondary bearers (303) to receive concrete.

Figure 5A:
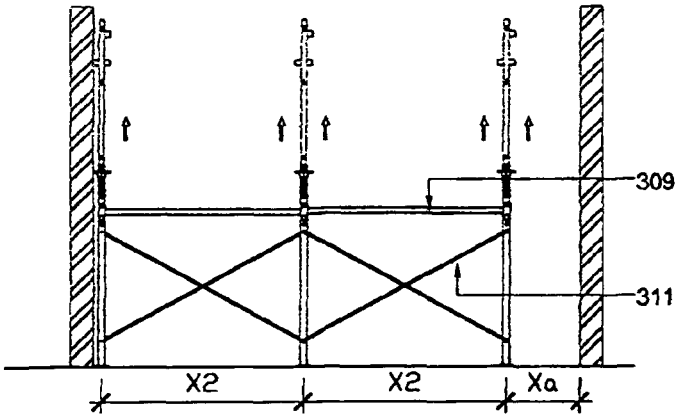
FIG. 5A shows a sectional side view of the placement of walkways on a plurality of horizontal tie units in a slab formwork system.
Figure 5:
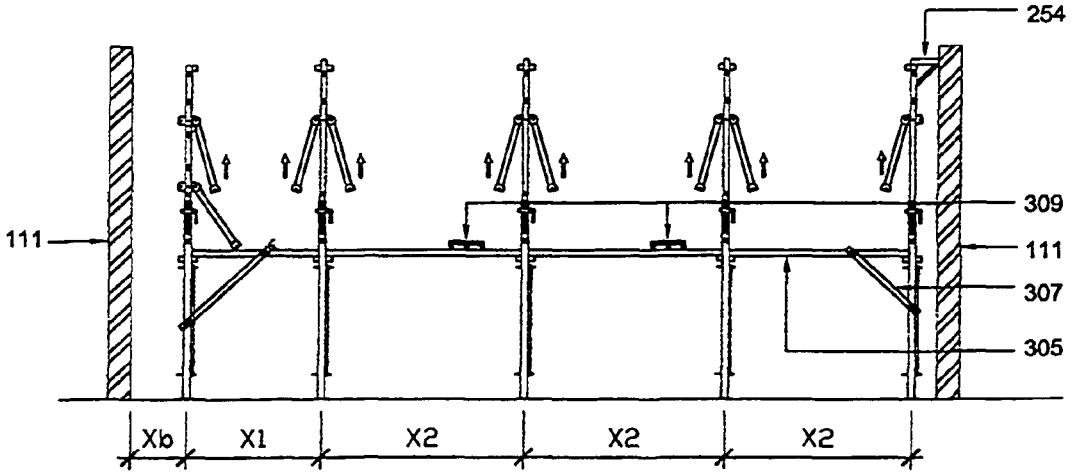
FIG. 5 shows a sectional front view of the placement of walkways on a plurality of horizontal tie units in a slab formwork system.

The system (100) further includes a plurality of horizontal tie units (305) wherein the vertical main members (101,102,103) of the system (100) are connectable by a plurality of horizontal tie units (305) and a pair of cross braces (311). A connector, such as a pocket (214) is used to connect the vertical main members (101,102,103) and the horizontal tie units (305) as seen in FIG. 2. Various other connectors may be used for this purpose such as a U-shaped clamp, nut and bolt, a horizontal bar and pin, and key-hole shaped inserts. At least one walkway (309) for the use of operators or workers is positioned on the horizontal tie units (305) which are illustrated in FIGS. 5 and 11.

The system (100) also includes at least one diagonal bracing (307) connectable to a horizontal tie unit (305) at one end and a vertical main member (101,102,103) at an opposing end wherein the diagonal bracing (307) additionally supports the vertical main member (101,102,103) and the horizontal tie unit (305) as illustrated in FIGS. 4 and 11. A pair of cross braces (311) may be used to support and balance the system (100) where said cross braces (311) cross extend between two adjacent vertical main members (101,102,103) as seen in FIGS. 4A, 5A, 6A, 7A, 11 and 11A.

In this embodiment of the invention, a strut pipe (319) is used to support a vertical main member (103) at a terminal end next to a wall (111) as shown in FIG. 11A. The strut pipe (319) is connected diagonally from the vertical main member (103) to a tie pipe (321). The tie pipe (321) is positioned below and parallel to the secondary bearer (303). The strut pipe (319) and tie pipe (321) are positioned such that the secondary bearer (303) is provided with additional support. FIG. 11A depicts a tie (323) disposed between two adjacent vertical main members (101) where the tie (323) is held in place by a pocket (224) disposed on the upper portion (116) of the vertical main members (101) as seen in FIGS. 1B and 11A.

In FIG. 11B, the concrete slab (409) is shown to be supported by a filler panel (410) between two adjacent panels (407). A seen in FIG. 11B, the filler panel (410) is positioned between two adjacent panels (407) with a void between the two adjacent panels (407) wherein the filler panel (410) is relatively shorter in length than said void. The filler panel (410) is positioned such that the void created between the filler panel (410) and the adjacent panels (407) is sealed by an adhesive tape.

A method of laying slab formwork using a plurality of vertical support members supporting a plurality of panels (407) is described. A plurality of vertical main members (101,102,103) are spaced apart and connected to each other using a plurality of horizontal tie units (305) and a pair of cross braces (311) as seen in FIGS. 4 and 4A. The height of each vertical main member (101,102,103) is adjusted such that each top of the vertical main member (101,102,103) is at the same level when referenced from an imaginary lower horizontal line. The imaginary lower horizontal line is produced by projecting a laser beam from one end of a wall (111) to a second wall at an opposite end. The imaginary lower horizontal line is used as a reference point to ensure that each top of the vertical main member (101,102,103) is leveled. The imaginary lower horizontal line may also be produced by other means such as a length of string from one end of a wall (111) to a second wall at an opposite end. An operator is able to stand on a floor and use the imaginary lower horizontal line as a reference point. To ensure that the height of each vertical main member (101,102,103) is the same from the top of the vertical main member (101,102,103) to the imaginary lower horizontal line in one embodiment of the invention, an operator uses a numbered scale along the length of the vertical main members (101,102,103). The operator may also measure a required height of one vertical main member (101,102,103) and use a first level marking (316) to indicate the imaginary horizontal reference line as seen in FIG. 2. A second level marking (317) is indicated on the vertical main member (101, 102,103) to indicate the required height to be adjusted by the height adjustable means (202) as seen in FIGS. 1 and 2. The level markings (316, 317) may be indicated by a temporary marking means such as an adhesive tape or a chalk in order for it to be erased after use.

Figure 6A:
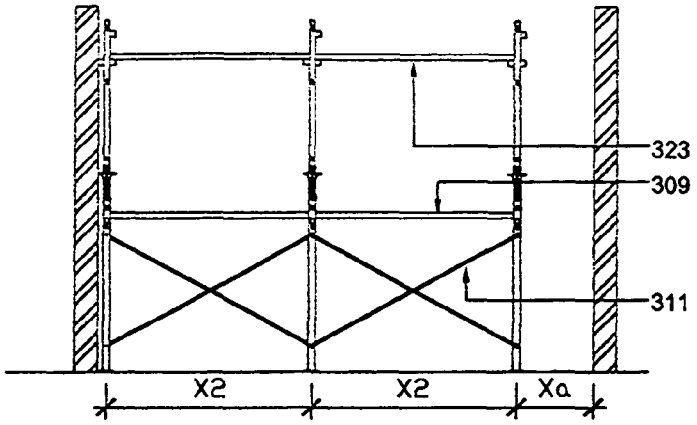
FIG. 6A shows a sectional side view of the positioning of a tie and primary bearers on the vertical main members in a slab formwork system.
Figure 6:
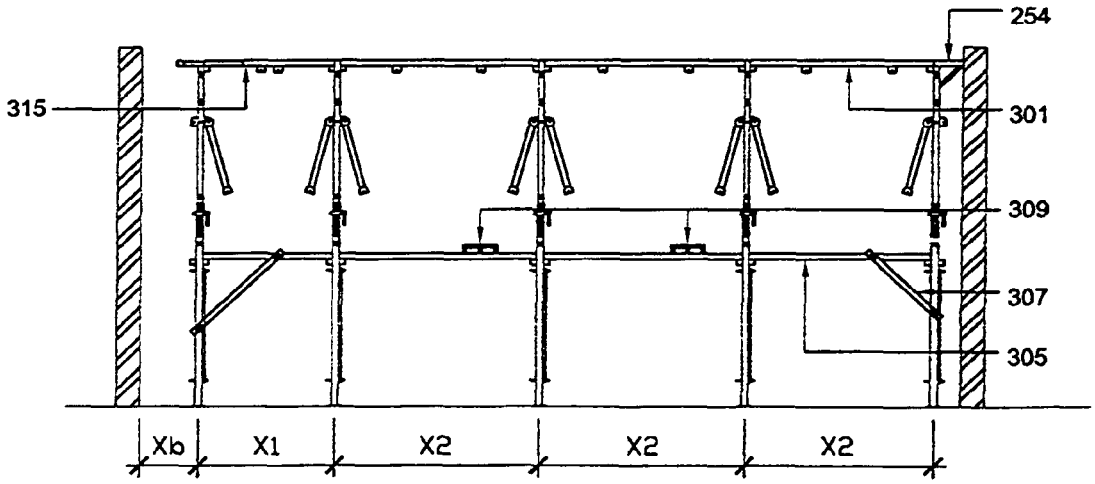
FIG. 6 shows a sectional front view of the positioning of primary bearers on the vertical main members in a slab formwork system.
Figure 7A:
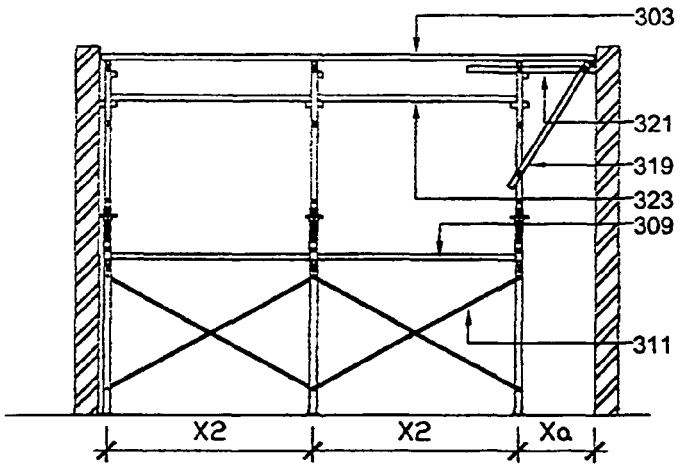
FIG. 7A shows a sectional side view of the positioning of secondary bearers disposed on the primary bearers in a slab formwork system.

A tie (323) is positioned between two adjacent vertical main members (101,103) as seen in FIG. 6A by using a pocket (224) to hold the tie (323) in place. A primary bearer (301) is positioned flat on top of the vertical main members (101,102, 103) as seen in FIG. 6. This is followed by a secondary bearer (303) positioned perpendicular and flat on top of the primary bearers (301) as seen in FIGS. 7 and 7A.

Figure 7:
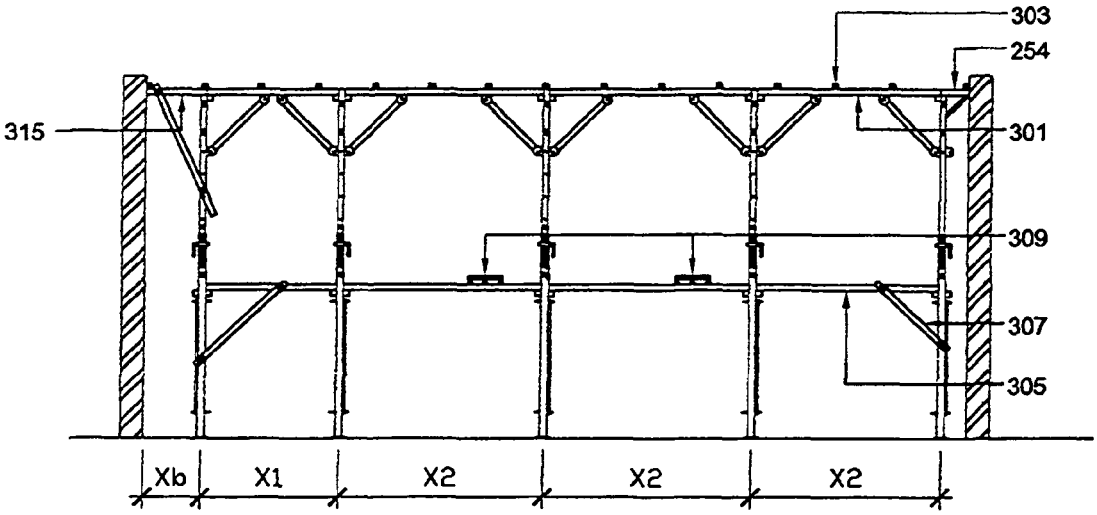
FIG. 7 shows a sectional front view of the positioning of secondary bearers disposed on the primary bearers in a slab formwork system.
Figure 9B:
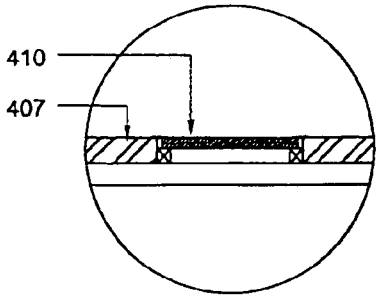
FIG. 9B is a magnified cross section view showing a filler panel between adjacent panels in a slab formwork system.
Figure 9A:
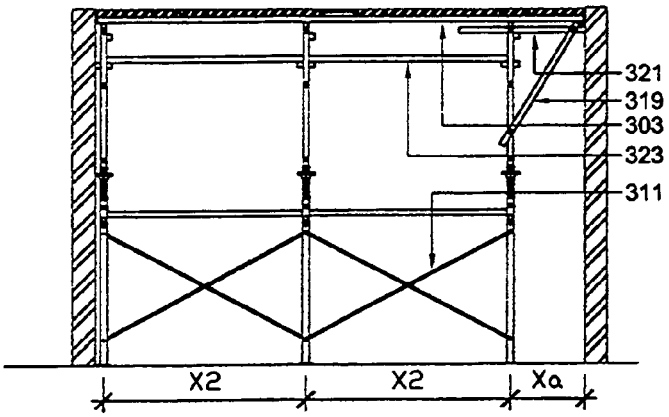
FIG. 9A shows a sectional side view of positioning a plurality of panels on secondary bearers in a slab formwork system.
Figure 9:
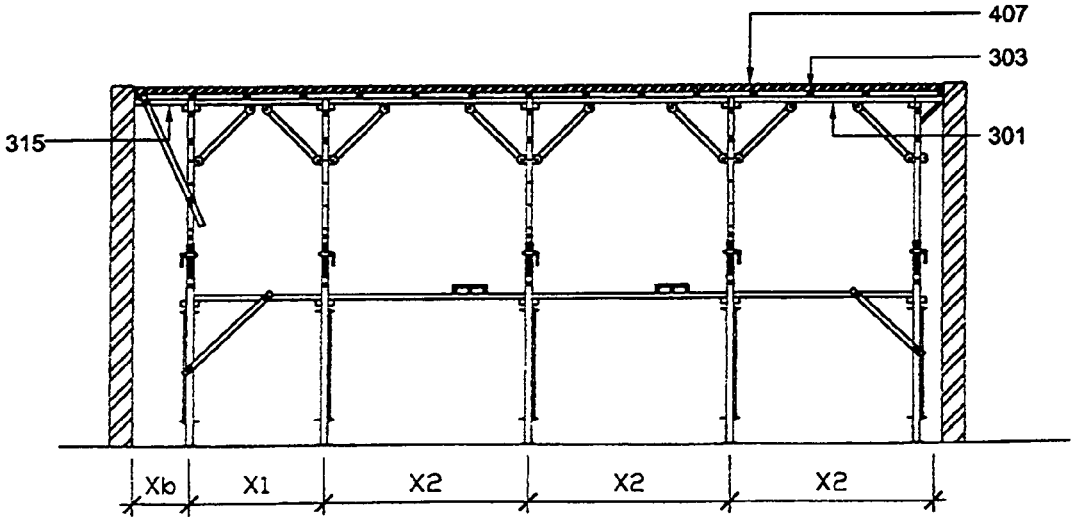
FIG. 9 shows a sectional front view of positioning a plurality of panels on secondary bearers in a slab formwork system.
Figure 10B:
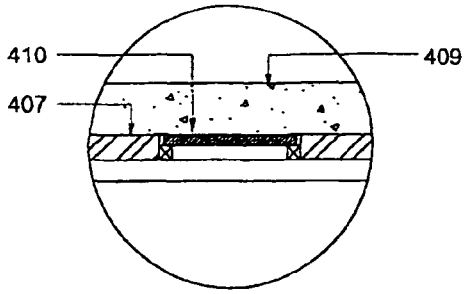
FIG. 10B is a magnified cross section view of poured concrete in a slab formwork system.
Figure 10A:
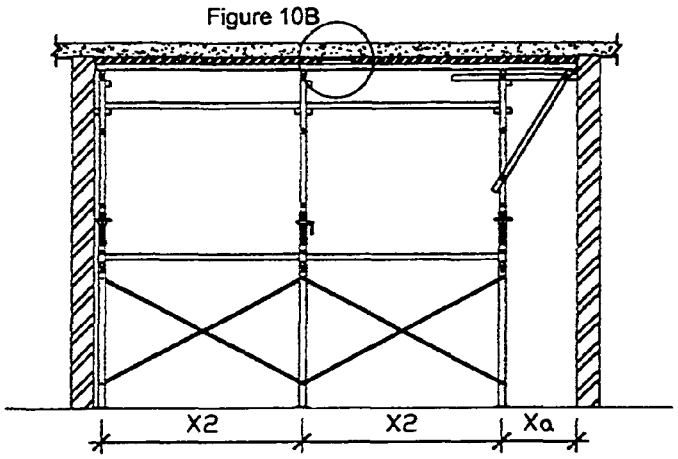
FIG. 10A shows a sectional side view of poured concrete in a slab formwork system.
Figure 10:
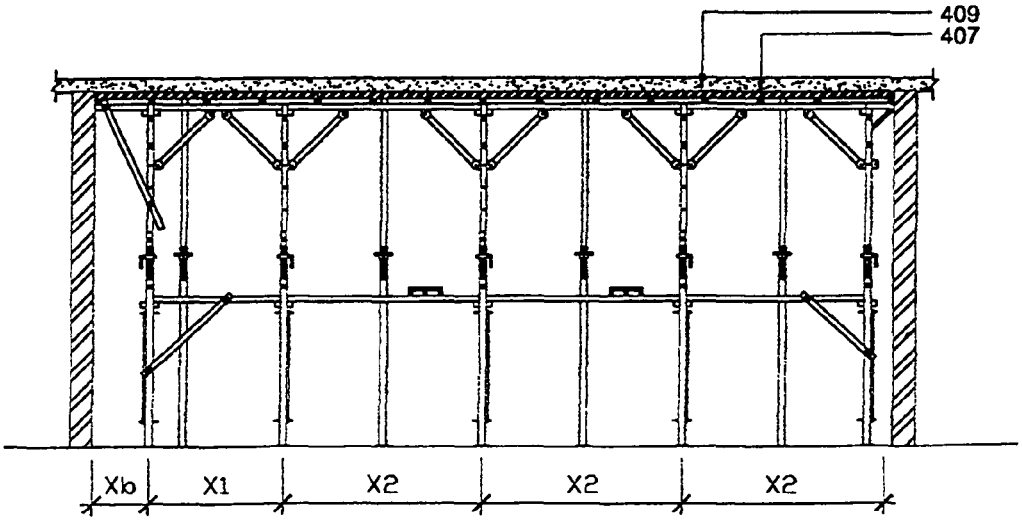
FIG. 10 shows a sectional front view of poured concrete in a slab formwork system.

Furthermore, a plurality of adjustable struts (246) is connected to the primary bearer (301) wherein the adjustable struts (246) are hinged along each vertical main member (101,102,103) as seen in FIGS. 6 and 7. At least one terminal end of the primary bearers (301) is then secured to a wall (111) by using an adjustable means such as a longitudinally extendable element (315). The longitudinally adjustable element (315) is seen in FIGS. 2 and 7. A plurality of panels (407) is disposed on top of the plurality of primary and secondary bearers (301, 303). A filler panel (410) is disposed between two adjacent panels (407) as seen in FIGS. 9, 9A and 9B. A void is created between the filler panel (410) and the adjacent panels (407) and the void is sealed by an adhesive tape to ensure concrete does not seep through. Concrete is received on top of the plurality of panels (407) wherein a concrete slab (409) is formed as illustrated in FIGS. 10, 10A and 10B.

Additionally as shown in FIG. 6, a walkway (309) is disposed on a horizontal tie unit (305) to provide a platform to walk on for workers or operator. A diagonal bracing (307) is connected from the vertical main member (101,102,103) to the horizontal tie unit (305).

The height of the vertical main members (101,102,103) is adjusted by the height adjustable means (202) which is a telescopically engageable means connectable to the lower longitudinal member (115) and the upper longitudinal member (116) and wherein the lower longitudinal member (115) supports a bar pin (212) bearing upon a nut (211) and wherein the nut (211) is axially moveable along the lower longitudinal member (115). The height adjustable means (202) is done by hand without the need for any hand tools.

A method of removing slab formwork, said formwork comprises of a plurality of vertical support members supporting a plurality of panels includes the steps of positioning height adjustable props (502) between ground level and a filler panel (410), removing vertical main members (101,102, 103) while leaving height adjustable props (502) in said position and removing height adjustable props (502) upon complete hardening of concrete slab (409).

Figure 12B:
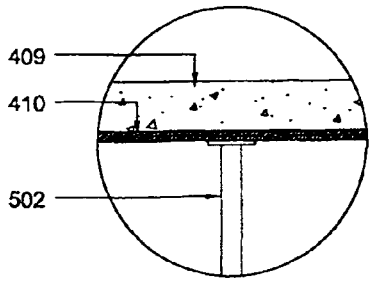
FIG. 12B is a magnified sectional view of a concrete slab on a filler panel that is supported by height adjustable props in a slab formwork system.
Figure 12A:
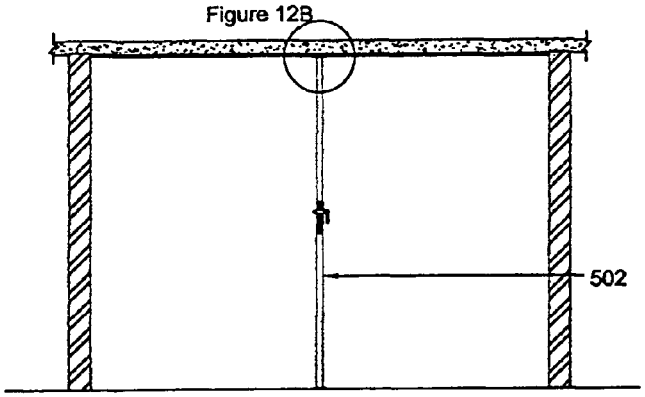
FIG. 12A shows a sectional side view of height adjustable props supporting the filler panel in a slab formwork system.
Figure 12:
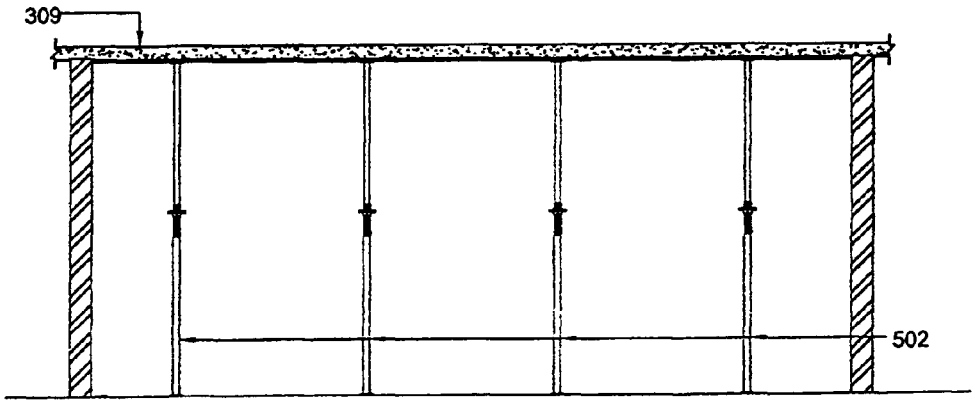
FIG. 12 shows a sectional front view of height adjustable props supporting the filler panel in a slab formwork system.

As seen in FIG. 11, the concrete (409) is left to form over a predetermined period of time, such as 3 days after which the slab formwork system (100) is removed leaving only the height adjustable props (502), which will be eventually removed. FIGS. 12, 12A and 12B shows the concrete slab (409) hardening while only being supported by the height adjustable props (502) and the plurality of vertical main members (101,102,103) have been removed. The filler panel (410) and the height adjustable props (502) are the only parts of the system (100) remaining to support the concrete slab (409). The removed slab formwork system (100) is then able to be reused in other floors or other cycles which reduce the cycle time for each slab formwork system (100).

It is to be understood that the embodiments of the invention described are exchangeable for other variations of the same in order to be used in various applications. The present embodiment of the invention is intended for, but not restricted to, use in the construction field.

The invention claimed is:

1. A slab formwork system comprising:

i. a plurality of vertical main members whose height is adjustable by an operator such that each top of the vertical main member is at the same level when referenced from an imaginary lower horizontal line;

ii. at least one primary bearer being supported by the plurality of vertical main members, wherein each vertical main member is perpendicular to each primary bearer;

iii. a pair of adjustable struts in each vertical main member, wherein each adjustable strut is diagonally connectable to the vertical main member and the at least one primary bearer;

iv. a plurality of height adjustable props connectable perpendicularly to at least one filler panel;

v. a plurality of secondary bearers being disposed perpendicular to the primary bearers;

vi. a longitudinally extendable element connectable to a terminal end of the primary bearer; and vii. a plurality of panels assembled on top of the plurality of secondary bearers to receive concrete;

wherein each of the at least one filler panel is disposed between at least two of said plurality of panels.

2. The slab formwork system as claimed in claim 1, further comprising a diagonally positioned strut pipe configured to support the longitudinally extendable element, the plurality of vertical main members being connected to the strut pipe by a clamp.

3. The slab formwork system as claimed in claim 1, wherein the vertical main members are connectable by a plurality of horizontal tie units and a pair of cross braces.

4. The slab formwork system as claimed in claim 3, wherein the plurality of horizontal tie units are connected to the vertical main members using a pocket.

5. The slab formwork system as claimed in claim 3, wherein at least one diagonal bracing is connected to a horizontal tie unit at one end and a vertical main member at an opposing end, wherein the diagonal bracing additionally supports a vertical main member and a horizontal tie unit.

6. The slab formwork system as claimed in claim 1, wherein at least one walkway is disposed on the horizontal tie units.

* * * * *